US008611577B2

(12) United States Patent
Jung et al.

(10) Patent No.: US 8,611,577 B2
(45) Date of Patent: Dec. 17, 2013

(54) PORTABLE TERMINAL WITH DUCT FOR TRANSMITTER

(75) Inventors: Jee-Young Jung, Seoul (KR); Sung-Min Jang, Gyeonggi-do (KR); Hoon Namkoong, Seoul (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 38 days.

(21) Appl. No.: 13/212,464

(22) Filed: Aug. 18, 2011

(65) Prior Publication Data

US 2012/0128191 A1 May 24, 2012

(30) Foreign Application Priority Data

Nov. 23, 2010 (KR) ..... 10-2010-0116725

(51) Int. Cl.
*H04R 25/00* (2006.01)

(52) U.S. Cl.
USPC ..... 381/355; 381/361; 381/365

(58) Field of Classification Search
USPC ..... 381/91, 355, 356, 357, 358, 360, 361, 381/365, 368; 379/420.03, 433.03
See application file for complete search history.

(56) References Cited

U.S. PATENT DOCUMENTS 3,947,646 A * 3/1976 Saito ..... 381/368
5,210,793 A * 5/1993 Carlson et al. ..... 379/433.03
2007/0237348 A1 * 10/2007 Phillips ..... 381/355

* cited by examiner

*Primary Examiner* — Huyen D Le
(74) *Attorney, Agent, or Firm* — Cha & Reiter, LLC

(57) ABSTRACT

Provided is a portable terminal including a microphone hole formed to perforate from an outer wall of a housing to an inner wall of the housing, a duct groove extending from an inner side of the housing and being open on a top surface thereof, a microphone holder coupled with the top surface of the duct groove, and a microphone coupled with the microphone holder, in which a duct connected to the microphone hole is formed by coupling the microphone holder with the duct groove, and the microphone is connected with the microphone hole through the duct. The duck is formed by coupling the duct groove formed in the housing of the terminal with the microphone holder coupled with the microphone, thereby smoothly delivering input sound such as user's voice to the microphone and contributing to the slimness of the terminal.

19 Claims, 6 Drawing Sheets

PORTABLE TERMINAL WITH DUCT FOR TRANSMITTER

CLAIM OF PRIORITY

This application claims the benefit under 35 U.S.C. §119 (a) of a Korean Patent Application filed in the Korean Intellectual Property Office on Nov. 23, 2010 and assigned Serial No. 10-2010-0116725, the entire disclosure of which is hereby incorporated by reference.

BACKGROUND OF THE INVENTION

1. Field of the Invention

The present invention relates to a portable terminal, and more particular to, a portable terminal having a transmitter for providing an audio input function for voice communication, etc.

2. Description of the Related Art

Generally, a portable terminal enables a user on the move to perform voice communication, message transmission/reception, schedule management, and reproduction of music files or moving pictures. With the development of electronic and communication technologies, the portable terminals have been miniaturized and have been equipped with other functions such as Internet or mobile banking services.

Meanwhile, to provide a voice communication function or a recording function, a portable terminal includes a transmitter equipped with a microphone for which a coin type microphone having a thin thickness smaller than a width thereof is often used.

FIG. 1 is a structural diagram of a known transmitter 10 of a portable terminal. As shown in FIG. 1, the transmitter 10 according to includes a microphone hole 13 formed to perforate from an outer wall into an inner wall of a housing 11. Inside the housing 11, a microphone 17 is mounted in a position corresponding to the microphone hole 13. The microphone 17 is installed inside a microphone holder 15 which is fixed inside the housing 11.

As shown in FIG. 1, the microphone 17 is an icon-type microphone and is disposed long in a longitudinal direction of the housing 11, taking account of a thickness of the portable terminal 10. In other words, the microphone hole 13 is disposed to face a front surface of the housing 11 and a sound input direction in which user's voice or the like is input is oriented in a sound input direction I of the microphone 17. Such disposition makes it easy to mount the microphone 17 in a slim portable terminal because the thickness of the microphone 17 is smaller than the width thereof.

Recently, with the common use of a portable terminal having mounted a touch screen therein, a microphone hole of a transmitter is usually disposed at a side of a housing of the terminal to improve the exterior design, more specifically, on a lower end portion of the housing. In this case, it is desirable to orient the sound input direction of a microphone toward the lower end portion of the housing, increasing the thickness of the terminal. Thus, the microphone is installed in the longitudinal direction, and a duct is formed from the microphone hole formed in the lower end portion of the housing up to the sound input position of the microphone.

FIGS. 2 through 4 show a conventional portable terminal in which a microphone is disposed long in the longitudinal direction of a housing where a duct is formed to connect the microphone with a microphone hole formed in the housing. The sound input direction I of a microphone 27 is oriented toward a front side or a rear side of a housing 21, but sound, such as user's voice, is substantially input in a longitudinal direction of the housing 21 from a lower end portion of the housing 21. When the voice sound arrives in the front side of the microphone 27, it travels in the same direction as the sound input direction I of the microphone 27.

The microphone 27 is disposed in the housing 21 while being enclosed by a microphone holder 25 made of an elastic material. The microphone holder 25 is fixed by a structure, such as a fixing rib, formed on the housing 21. In the microphone holder 25 is formed a duct 29 for connecting the microphone holder 23 with a sound input portion of the microphone 27. The duct 29 forms a portion of the microphone holder 25, such that the duct 29 is enclosed by the material forming of the microphone holder 25.

However, such a conventional transmitter structure has to entirely enclose the duct 29 with the same material as the microphone holder 25 which is a drawback in efforts to reduce the thickness of the transmitter structure. In other words, in a lower end portion of the microphone holder 25 shown in FIG. 3, the lower end portion of the microphone holder 25 enclosing the duct 29 needs to have a larger thickness to maintain the shape of the duct 29. Moreover, to smoothly deliver user's voice to the microphone 27, the duct 29 has to have a predetermined size. Therefore, there is a limitation in reduction of the thickness of the microphone holder 25 due to above requirements, thus hindering design efforts in miniaturization and slimness of the terminal.

SUMMARY OF THE INVENTION

Accordingly, an aspect of the present invention is to provide a portable terminal having a duct for a transmitter, which contributes to miniaturization of the terminal of the type having a microphone hole disposed on the side of a housing.

According to an aspect of the present invention, there is provided a portable terminal including a microphone hole formed to perforate from an outer wall of a housing to an inner wall of the housing, a duct groove extending from an inner side of the housing and being open on a top surface thereof, a microphone holder coupled with the top surface of the duct groove, and a microphone coupled with the microphone holder, in which a duct connected to the microphone hole is formed by coupling the microphone holder with the duct groove, and the microphone is connected with the microphone hole through the duct.

The portable terminal may further include a first guide rib formed on the inner side of the housing, in which the duct groove is a space formed by being enclosed by the first guide rib.

The portable terminal may further include a second guide rib formed on the microphone holder, in which the second guide rib closely contacts a top end portion of the first guide rib to form the duct.

The portable terminal may further include a fixing rib provided to enclose the first guide rib, in which the microphone holder is fixed on the inner side of the housing while being enclosed by the fixing rib.

The portable terminal may further include a sealing member on an outer circumferential surface of the microphone holder, in which the sealing member closely contacts an inner wall of the fixing rib.

The portable terminal may further include a fixing groove formed in an inner wall of the fixing rib, in which the sealing member is engaged with the fixing groove to fix the microphone holder in the housing.

The duct groove may include a duct portion extending from the microphone hole to the inner side of the housing and a connection portion provided on an end portion of the duct portion, and the microphone may be disposed to face the connection portion.

The portable terminal may further include an opening formed in the microphone holder, in which the microphone is disposed to face the connection portion through the opening.

BRIEF DESCRIPTION OF THE DRAWINGS

The above and other features and advantages of an exemplary embodiment of the present invention will be more apparent from the following detailed description taken in conjunction with the accompanying drawings, in which.

DETAILED DESCRIPTION OF THE INVENTION

Hereinafter, an exemplary embodiment of the present invention will be described in detail with reference to the accompanying drawings. For the purposes of clarity and simplicity, a detailed description of known functions and configurations will be omitted as it may unnecessarily obscure the subject matter of the present invention.

Figure 1:
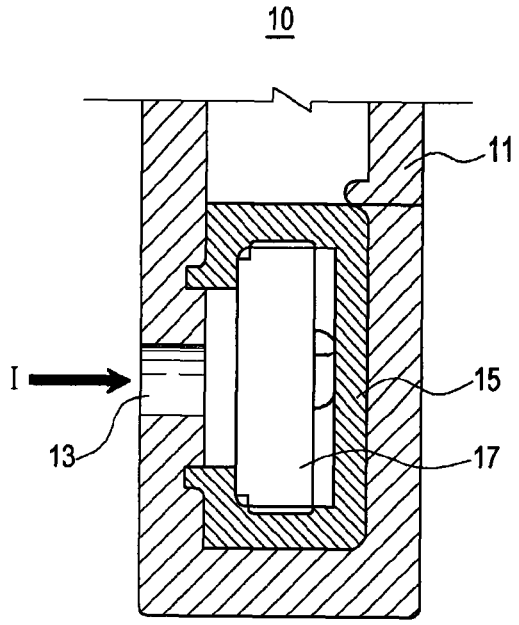
FIG.1 (PRIOR ART)
FIG. 1 is a cross-sectional view of a transmitter of a portable terminal according to an embodiment of conventional art.
Figure 2:
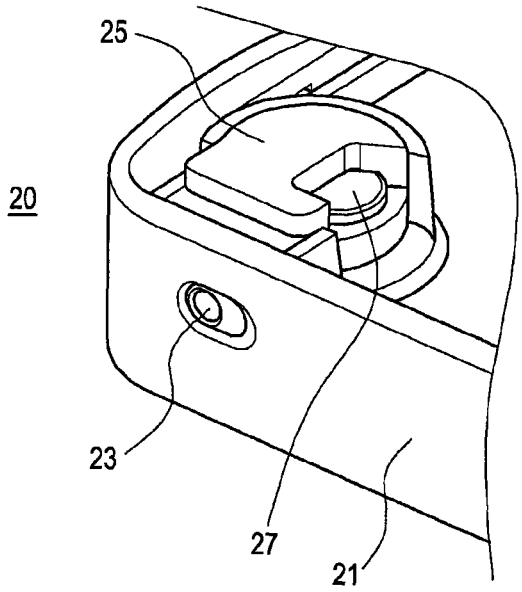
FIG.2 (PRIOR ART)
FIG. 2 is a perspective view of a transmitter of a portable terminal according to another embodiment of conventional art.
Figure 3:
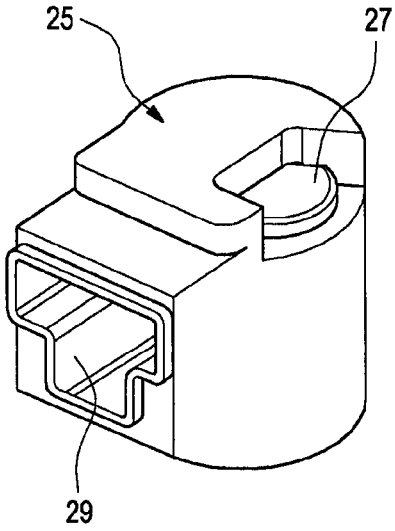
FIG.3 (PRIOR ART)
FIG. 3 is a perspective view of a microphone holder of the transmitter shown in FIG. 2.
Figure 4:
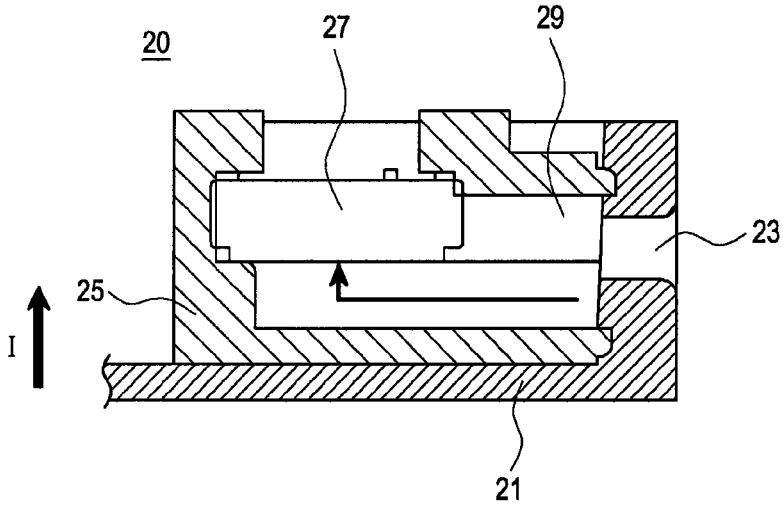
FIG.4 (PRIOR ART)
FIG. 4 is a cross-sectional view of the transmitter shown in FIG. 2.
Figure 5:
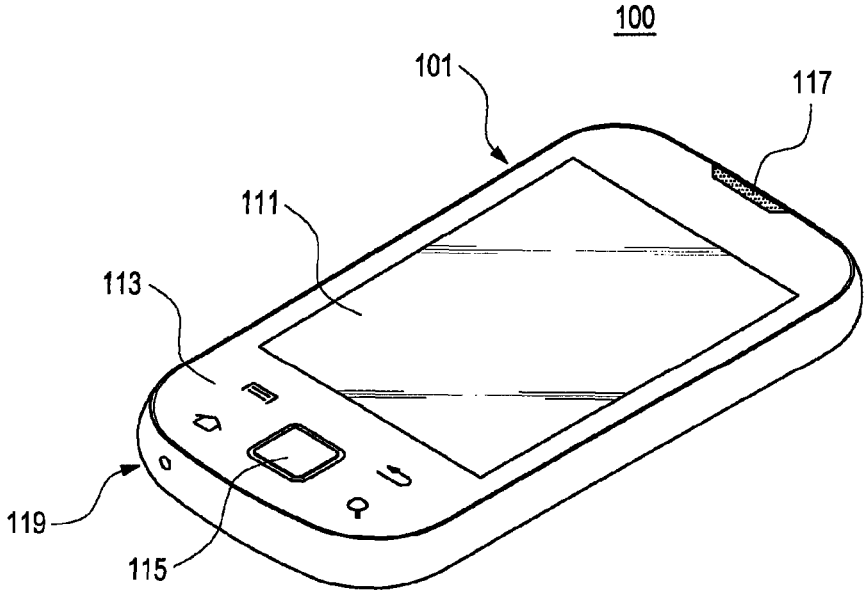
FIG. 5 is a perspective view of a portable terminal according to an exemplary embodiment of the present invention.

Referring to FIG. 5, a portable terminal 100 according to an exemplary embodiment of the present invention is a bar-type terminal in which a transmitter 119 is formed on a lower end portion of a housing 101. Although a bar-type terminal has been used as an illustrative example of the portable terminal 100 in an embodiment of the present invention, it would be easily understood by those of ordinary skill in the art that the portable terminal 100 may be a terminal equipped with a microphone, i.e., any-type terminal such as a folder-type terminal or a sliding-type terminal having a function of inputting user's voice or external sound.

In the portable terminal 100, a display device 111 having a touch screen function is installed on a front side of the housing 101, and a receiver 117 is disposed in an upper portion with respect to the display device 111. A user may use a keypad 113 to switch an operation mode of the portable terminal 100, for example, a call mode, a text input mode, a music/moving image play mode, or the like, or to call various menus. The user may also perform detailed manipulation in various operation modes by combining a touch screen implemented with the display device 111 and the keypad 113.

With reference to FIGS. 6 through 11, a detailed structure of the transmitter 119 according to the embodiment of the present invention will be described hereinafter.

Figure 9:
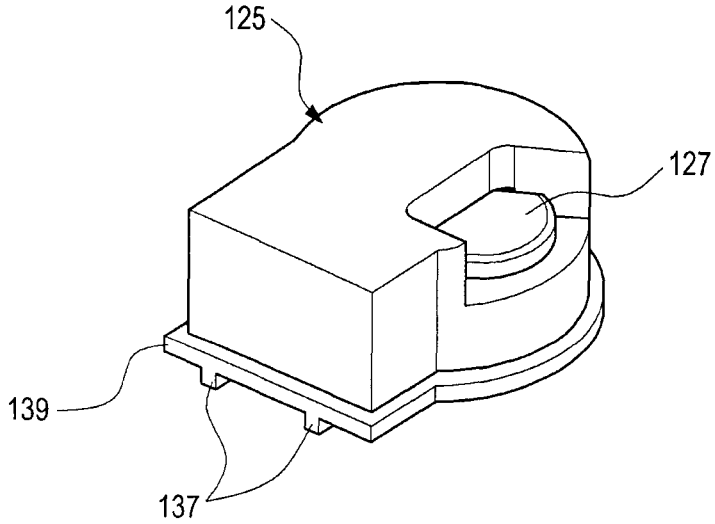
FIG. 9 is a perspective view of a microphone holder of the transmitter shown in FIG. 6.
Figure 10:
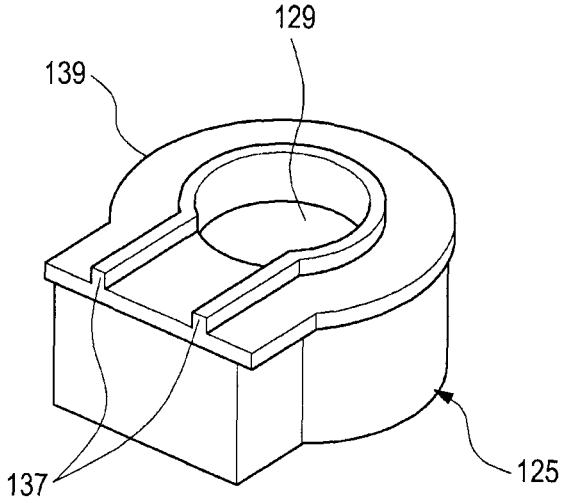
FIG. 10 is a perspective view of the microphone holder shown in FIG. 9, when viewed from another side.
Figure 11:
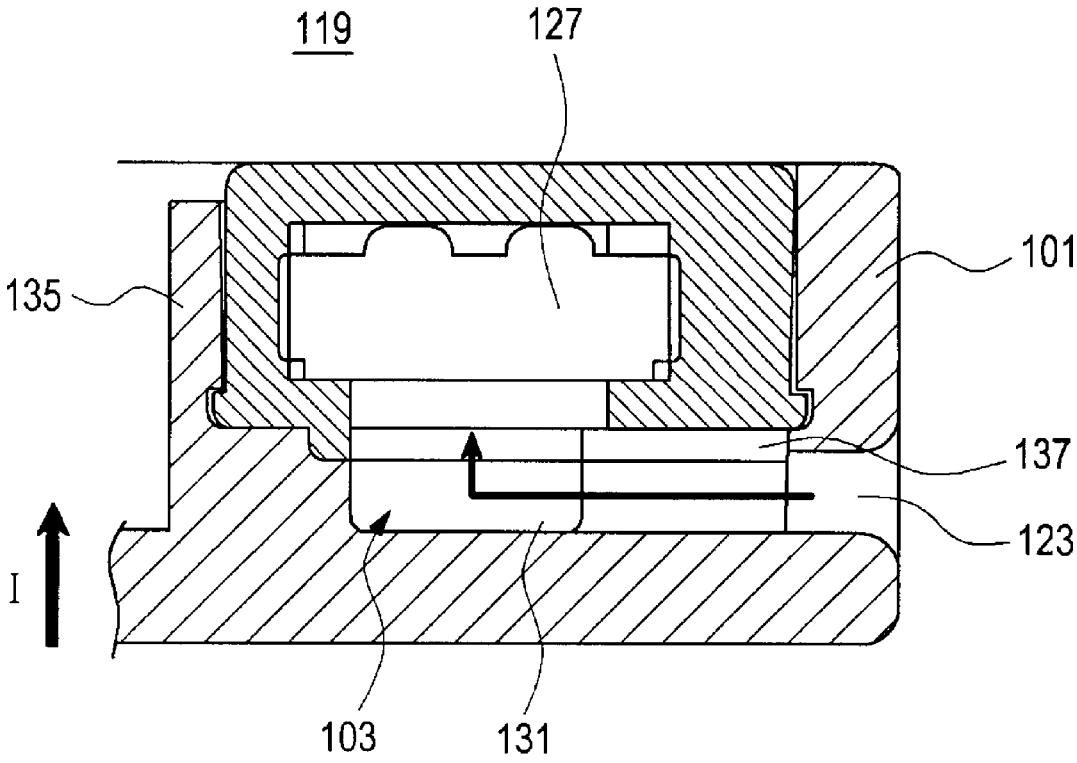
FIG. 11 is a cross-sectional view of the transmitter shown in FIG. 6.

As shown in FIGS. 6 through 11, the transmitter 119 of the portable terminal 100 forms a duct 103 shown in FIG. 11 by coupling a duct groove 131 formed in the housing 101 with a microphone holder 125. A microphone 127 installed in the microphone holder 125 is connected with a microphone hole 123 formed in the housing 101 through the duct 103.

Figure 6:
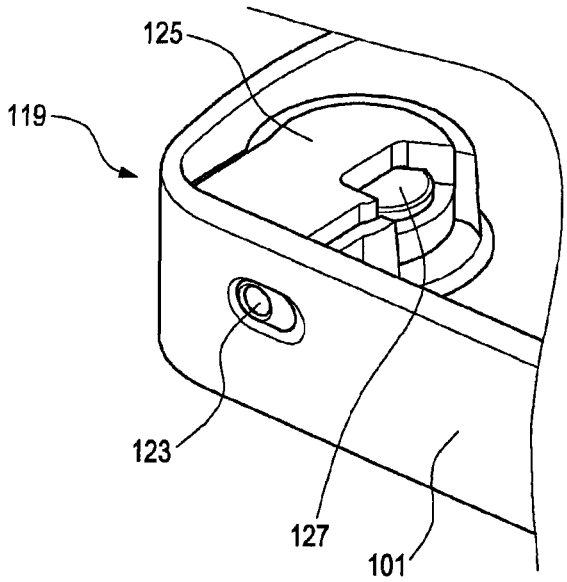
FIG. 6 is a perspective view of a transmitter of the portable terminal shown in FIG. 5.

Referring to FIG. 6, the microphone hole 123 is formed to perforate from an outer wall into an inner wall of the housing 101, and the duct groove 131 is formed inside the housing 101. The duct groove 131 may be formed by denting a portion of an inner circumferential surface of the housing 101, and an end of the duct groove 131 is connected with the microphone hole 123. In the embodiment of the present invention, the duct groove 131 is formed by being enclosed by a first guide rib 133 formed in the inner circumferential surface of the housing 101.

Figure 7:
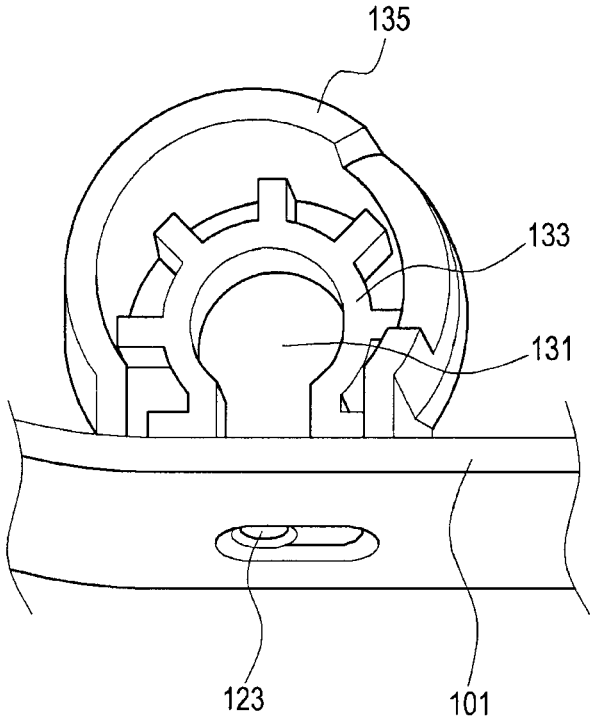
FIG. 7 is a perspective view of a duct groove of the transmitter shown in FIG. 5.

As shown in FIG. 7, the duct groove 131 is open on a top surface thereof.

Figure 8:
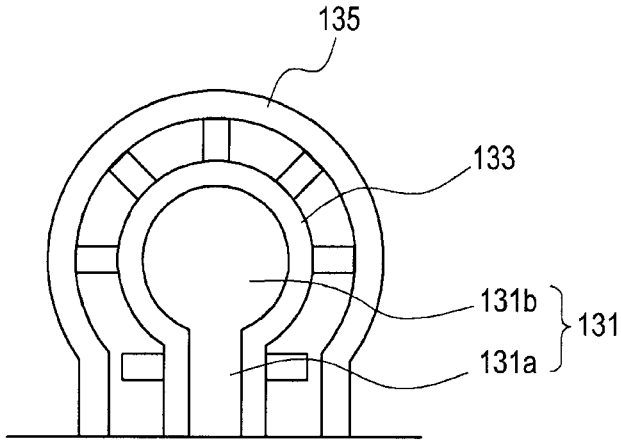
FIG. 8 is a plane view of the duct groove shown in FIG. 7.

As shown in FIG. 8, the duct groove 131 may include a duct portion 131*a* extending from the microphone hole 123 and a connection portion 131*b* provided on an end portion of the duct portion 131*a*. The connection portion 131*b* is in the shape of a circle having a larger diameter than a width of the duct portion 131*a*. On the inner circumferential surface of the housing 101 is formed a fixing rib 135 enclosing the first guide rib 133. The fixing rib 135 provides a means for fixing the microphone holder 125.

Although the first guide rib 133 or the fixing rib 135 which forms the duct groove 131 protrudes from the inner circumferential surface of the housing 101 in the embodiment of the present invention, the duct groove 131 may be formed by denting the inner circumferential surface of the housing 101, or a groove capable of receiving the microphone holder 125 may be formed by denting the inner circumferential surface of the housing 101 if the housing 101 has a sufficient thickness.

Referring to FIGS. 9 and 10, the microphone holder 125 is made of an elastic material, and when the microphone holder 125 is disposed in the housing 101, a bottom surface thereof is coupled with an open top surface of the duct groove 131 to form the duct 103. The microphone 137 is disposed in the microphone holder 125 to be installed inside the housing 101. A portion of the microphone holder 125 may be cut to provide a path for coupling with the microphone 127.

As shown in FIGS. 9 and 10, a portion of a top surface of the microphone holder 125 is cut to provide a path for coupling with the microphone 127, and a portion of a bottom surface of the microphone holder 125 is open to form an opening 129. The opening 129 is open to a sound input direction of the microphone 127, thereby providing a traveling path of sound input to the microphone 127. On the bottom surface of the microphone holder 125 is formed a second guide rib 137 which protrudes from the bottom surface of the microphone holder 125 and extends to correspond to the shape of the duct groove 131.

As mentioned above, when the microphone holder 125 is installed in the housing 101, the bottom surface of the microphone holder 125 is coupled with the duct groove 131 to form the duct 103. By forming the second guide rib 137 and urging the second guide rib 137 to closely contact a top end portion of the first guide rib 133, the sound traveling in the duct 103 may be prevented from leaking outside the duct 103. That is, by forming the first guide rib 133 and the second guide rib 137, the remaining portion other than the sound traveling path is sealed. An end portion of the second guide rib 137 is preferably formed to enclose the opening 129.

On an outer circumferential surface of the microphone holder 125 is formed a sealing member 139. When the microphone holder 125 is installed in the housing 101, it is enclosed by the fixing rib 135 and the sealing member 139 closely contacts an inner wall of the fixing rib 135 to firmly fix the microphone holder 125.

Since the microphone holder 125 is made of an elastic material, the microphone holder 125 may be firmly fixed to the housing 101 by forming the microphone holder 125 larger than a space formed by the fixing rib 135. In this case, however, the microphone holder 125 maintains a compressed state at all times and thus may continuously impose load on the fixing rib 135. Therefore, to minimize the load, the sealing member 139 is preferably formed.

If a fixing groove engaged with the sealing member 139 is formed inside the fixing rib 135, the microphone holder 125 is prevented from leaving the fixing rib 135, and the close contact state between the first guide rib 133 and the second guide rib 137 can be firmly maintained.

Referring to FIG. 11, the microphone 127 is installed in a longitudinal direction of the housing 101 and a sound input direction I thereof is oriented toward the front side of the housing 101. The microphone hole 123 is formed to perforate from the outer wall to the inner wall on a side of the housing 101, more specifically, on a lower end portion of the housing 101. The duct 103 extends from the microphone hole 123 and is connected to the microphone 127. The microphone 127 is positioned to face the connection portion 131*b* of the duct groove 131 through the opening 129.

In other words, even though the microphone 127 is disposed in the microphone holder 125, it is connected to the duct 103 through the opening 129. Thus, sound input through the microphone hole 123 travels in the longitudinal direction of the housing 101, such that the sound is input to the microphone 127 along the sound input direction I of the microphone 127 at the connection portion 131*b*.

The portable terminal structured as described above forms a duct by coupling a duct groove formed in a housing of the terminal with a microphone holder coupled with a microphone, thereby smoothly delivering input sound such as user's voice to the microphone. In addition, the duct is formed by using the housing of the terminal, thus contributing to the slimness of the terminal.

While a detailed embodiment has been described in the present invention, it would be obvious to those of ordinary skill in the art that various changes may be made without departing from the scope of the present invention.

What is claimed is:

1. A portable terminal comprising:

a housing having a microphone hole to perforate from an outer wall of the housing to an inner wall of the housing, the microphone hole located in a plane along the outer wall;

a duct groove extending from an inner side of the housing and being open on a top surface thereof;

a microphone holder coupled with the top surface of the duct groove;

a microphone having a sound input direction, the microphone coupled with the microphone holder and wherein the sound input direction is oriented along an axis that is in a parallel orientation to the plane; and a duct formed by coupling the microphone holder with the duct groove, wherein the microphone is connected with the microphone hole through the duct.

2. The portable terminal of claim 1, further comprising a first guide rib formed on the inner side of the housing, wherein the duct groove is a space formed by being enclosed by the first guide rib.

3. The portable terminal of claim 2, further comprising a second guide rib formed on the microphone holder, wherein the second guide rib closely contacts a top end portion of the first guide rib to form the duct.

4. The portable terminal of claim 2, further comprising a fixing rib provided to enclose the first guide rib, wherein the microphone holder is fixed on the inner side of the housing while being enclosed by the fixing rib.

5. The portable terminal of claim 4, further comprising a sealing member on an outer circumferential surface of the microphone holder, wherein the sealing member closely contacts an inner wall of the fixing rib.

6. The portable terminal of claim 5, further comprising a fixing groove formed in an inner wall of the fixing rib, wherein the sealing member is engaged with the fixing groove to fix the microphone holder in the housing.

7. The portable terminal of claim 1, wherein the duct groove comprises a duct portion extending from the microphone hole to the inner side of the housing and a connection portion provided on an end portion of the duct portion, and wherein the microphone is disposed to face the connection portion.

8. The portable terminal of claim 7, wherein the connection portion comprises a circle shape having a larger diameter than a width of the duct portion.

9. The portable terminal of claim 7, the duct groove is formed by denting a portion of an inner circumferential surface of the housing.

10. The portable terminal of claim 7, wherein the microphone holder having an opening so that the microphone is disposed to face the connection portion through the opening.

11. A portable terminal comprising:

a housing having a microphone hole to perforate from an outer wall of the housing to an inner wall of the housing;

a duct groove extending from an inner side of the housing and being open on a top surface thereof;

a first guide rib formed on the inner side of the housing, wherein the duct groove is a space formed by being enclosed by the first guide rib;

a microphone holder coupled with the top surface of the duct groove;

a second guide rib formed on the microphone holder, wherein the second guide rib closely contacts a top end portion of the first guide rib to form the duct; and a microphone coupled with the microphone holder, a duct formed by coupling the microphone holder with the duct groove, wherein the microphone is connected with the microphone hole through the duct.

12. The portable terminal of claim 11, further comprising a first guide rib formed on the inner side of the housing, wherein the duct groove is a space formed by being enclosed by the first guide rib wherein the first guide rib is formed in the inner circumferential surface of the housing.

13. The portable terminal of claim 11, further comprising a fixing rib provided to enclose the first guide rib, wherein the microphone holder is fixed on the inner side of the housing while being enclosed by the fixing rib.

14. The portable terminal of claim 13, further comprising a sealing member on an outer circumferential surface of the microphone holder, wherein the sealing member closely contacts an inner wall of the fixing rib.

15. The portable terminal of claim 14, further comprising a fixing groove formed in an inner wall of the fixing rib, wherein the sealing member is engaged with the fixing groove to fix the microphone holder in the housing.

16. The portable terminal of claim 11, wherein the duct groove comprises a duct portion extending from the microphone hole to the inner side of the housing and a connection portion provided on an end portion of the duct portion, and wherein the microphone is disposed to face the connection portion.

17. The portable terminal of claim 16, wherein the connection portion comprises a circle shape having a larger diameter than a width of the duct portion.

18. The portable terminal of claim 16, the duct groove is formed by denting a portion of an inner circumferential surface of the housing.

19. The portable terminal of claim 16, wherein the microphone holder having an opening so that the microphone is disposed to face the connection portion through the opening.

* * * * *